United States Patent [19]

Yamada et al.

[11] Patent Number: 4,580,823

[45] Date of Patent: Apr. 8, 1986

[54] LOCK ARRANGEMENT FOR A VEHICLE SLIDING DOOR

[75] Inventors: Masaaki Yamada, Zama; Yasuo Yui, Isehara, both of Japan

[73] Assignee: Nissan Motor Company, Limited, Yokohama, Japan

[21] Appl. No.: 508,935

[22] Filed: Jun. 29, 1983

[30] Foreign Application Priority Data

Jul. 9, 1982 [JP] Japan ..... 57-119393

[51] Int. Cl.[4] ..... E05C 15/00

[52] U.S. Cl. ..... 292/340; 292/DIG. 46; 292/1; 296/155

[58] Field of Search ..... 49/213, 215, 503, 214; 296/155; 292/340, 216, 280, 337, DIG. 46, 1

[56] References Cited

U.S. PATENT DOCUMENTS

| | | | |
|---|---|---|---|
| 888,285 | 5/1908 | Wibel et al. | 70/97 |
| 1,173,884 | 2/1916 | Snapp | 70/97 |
| 3,111,339 | 11/1963 | Nadeau | 292/216 |
| 3,719,380 | 3/1973 | Watermann | 292/216 |
| 3,809,416 | 5/1974 | Kayaoka | 292/216 |
| 4,157,846 | 6/1979 | Whitcroft | 296/155 |
| 4,281,478 | 8/1981 | Inami | 49/503 |

FOREIGN PATENT DOCUMENTS

| | | |
|---|---|---|
| 2411865 | 9/1974 | Fed. Rep. of Germany . |
| 2372067 | 6/1978 | France . |
| 2434725 | 3/1980 | France . |
| 56-105079 | 8/1981 | Japan . |

*Primary Examiner*—Richard E. Moore

*Attorney, Agent, or Firm*—Schwartz, Jeffery, Schwaab, Mack, Blumenthal & Evans

[57] ABSTRACT

A vehicle includes a side body defining an opening. A sliding door covers the opening when the sliding door is in its closed position. One of a lock frame and a lock strike is fixed to the sliding door, and the other is fixed to the side body. A device serves to prevent the lock strike from directly contacting the lock frame when the side body and the sliding door in the closed position relatively approach each other out of their normally positional relationship.

6 Claims, 3 Drawing Figures

LOCK ARRANGEMENT FOR A VEHICLE SLIDING DOOR

BACKGROUND OF THE INVENTION

This invention relates to a lock arrangement for a sliding door of a vehicle, such as an automobile.

Some van-type automobiles have sliding doors. Several kinds of locks are conventionally applied to such sliding doors. The design of conventional locks do not adequately allow for automotive collisions, so that they are too easily damaged in such cases.

SUMMARY OF THE INVENTION

It is an object of this invention to provide a vehicle sliding door lock arrangement which can adequately withstand vehicle collisions.

In accordance with this invention, a lock arrangement is applied to a sliding door of a vehicle including a side body for defining an opening. The sliding door covers the opening when the sliding door is in its closed position. The side body and the sliding door define a first relative position when the sliding door is in the closed position. The lock arrangement includes a lock frame and a lock strike, one of which is fixed to the sliding door and the other of which is fixed to the side body. A device serves to prevent the lock strike from directly contacting the lock frame when the side body and the sliding door are displaced toward one another out of the first relative position.

The above and other objects, features and advantages of this invention will be apparent from the following description of a preferred embodiment thereof, taken in conjunction with the drawings.

DESCRIPTION OF THE PREFERRED EMBODIMENTS

Figure 1:
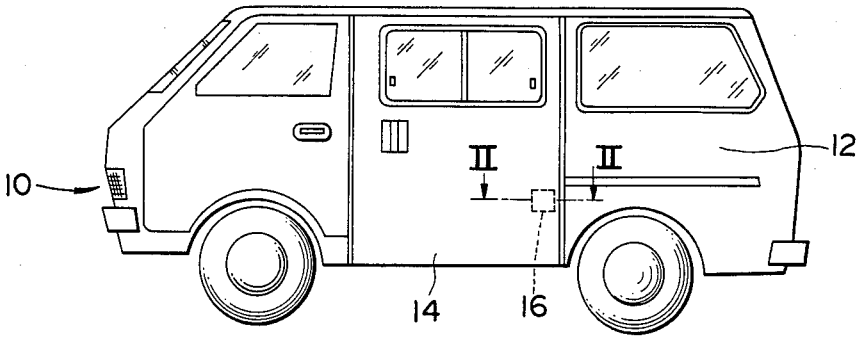
FIG. 1 is a side view of a van-type automobile including a sliding door to which a door-lock arrangement of this invention is applied.

With reference to FIG. 1, a van-type automobile 10 has a body, which includes a rear side portion 12 and a rearward sliding-type door 14 designed to cover an opening, i.e. a door frame, partially defined by the front edge of the rear side portion 12. A lock 16 for the sliding door 14 is located near the rear edge of the sliding door 14.

Figure 2:
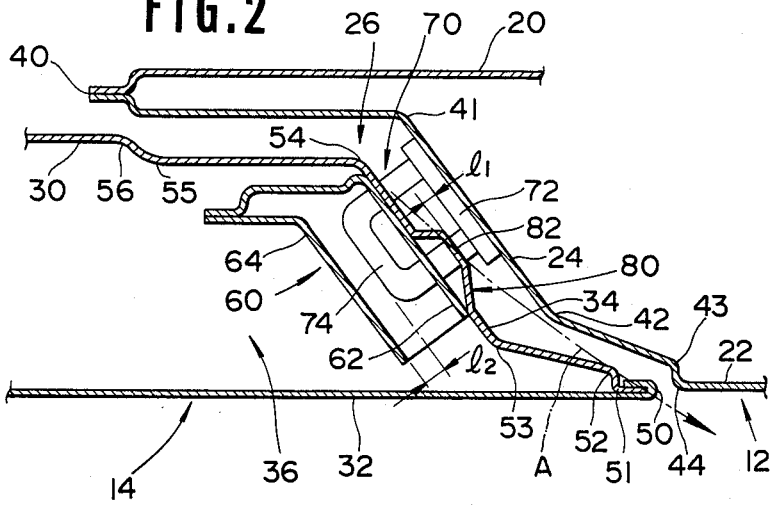
FIG. 2 is a horizontal cross-sectional view taken along line II—II of FIG. 1.

As shown in FIG. 2, the rear side portion 12 includes parallelly-spaced inner and outer panels 20 and 22, and a front panel 24 defining part of the above-mentioned opening 26. The inner and outer panels 20 and 22 extend longitudinally with respect to the automobile 10. The front panel 24 extends from the front edge of the outer panel 22 to the front edge of the inner panel 20. The front panel 24 is integral with the outer panel 22, and is attached to the inner panel 20.

When the sliding door 14 is closed as shown in FIG. 2, the sliding door 14 covers the opening 26. As shown in FIG. 2, the sliding door 14 includes parallelly-spaced inner and outer panels 30 and 32, and a rear panel 34. The door inner and outer panels 30 and 32 extend longitudinally with respect to the automobile 10. The door rear panel 34 extends from the rear edge of the inner panel 30 to the rear edge of the outer panel 32. The panels 30, 32, and 34 define an enclosed space 36 within the sliding door 14. The rear panel 34 is integral with the inner panel 30, and is attached to the outer panel 32. When the sliding door 14 is in its closed position as shown in FIG. 2, the door rear panel 34 opposes the front side panel 24 with a predetermined clearance while the door outer panel 32 is essentially flush with the outer side panel 22.

Starting from its point of attachment 40 with the inner side panel 20, the front side panel 24 extends essentially straight rearwards to a first concave bend 41 and then extends obliquely to a first convex bend 42. From the convex bend 42, which juts slightly outward into the opening 26, the front panel 24 extends obliquely for a relatively short distance to a second concave bend 43. From here, a very short section of the front panel 24 extends directly outwards to join the outer side panel 22 along an edge 44. Nearly the entire vertical extent of the front panel 24 has this same profile.

Starting from its points 50 and 51 of attachment with the door outer panel 32, the door rear panel 34 extends for a short distance directly inwards to a first convex bend 52. From there, the rear panel 34 extends obliquely for a somewhat longer distance to a first concave bend 53, which juts slightly into the space 36 within the door 14. The rear panel 34 then extends obliquely to a second convex bend 54 and then extends directly forward to a concave curve 55 which joins the door inner panel 30 via a convex curve 56. Most of the rear edge of the sliding door 14 has this same profile in horizontal cross-section.

The slide body and the sliding door define a first relative position when the sliding door is in closed position. The section of the door rear panel 34 between the bends 54 and 55 parallelly opposes and is distant a predetermined gap from the section of the front side panel 24 between the bend 41 and the edge 40 when the sliding door 14 is in the closed position. The section of the door rear panel 34 between the bends 53 and 54 parallelly opposes and is distant a predetermined gap from the section of the front side panel 24 between the bends 41 and 42 when the sliding door 14 is in the closed position. The section of the door rear panel 34 between the bends 52 and 53 opposes and is spaced from the section of the front side panel 24 between the bends 42 and 43 when the sliding door 14 is in the closed position. The rear edge 50 of the door outer panel 32 is spaced a predetermined distance from the front edge 44 of the outer side panel 22.

The predetermined gaps between the front side panel 24 and the door rear panel 34 are chosen so that the door rear panel 34 can remain out of contact with the front side panel 24 as the sliding door 14 moves into and out of the closed position. As the sliding door 14 moves into and out of the closed position, the door convex bend 54 travels along the trajectory shown by the dot/-dash line A in FIG. 2. The convex bend 42 and the projecting edge 44 of the rear side portion 12 lie rearward of the path A of the door convex bend 54 to prevent the bend 54 from contacting or striking the bend 42 and the edge 44.

As shown in FIG. 2, a door-lock main section 60 is located within the space 36 in the sliding door 14. The door-lock main section 60 includes a frame with parallelly-spaced plates 62 and 64. The first plate 62 is contiguously fixed to the section of the door rear panel 34 between the bends 53 and 54. The other base or back plate 64 is attached to an extension of the plate 62. The plates 62 and 64 extend parallel to the section of the door rear panel 34 between the bends 53 and 54.

A door-lock striker or strike 70 includes a base plate 72 and a U-shaped member 74 fixed to the base plate 72. The member 74 and the plate 72 form a closed loop in FIG. 2. The base plate 72 is contiguously, parallelly fixed to the section of the front side panel 24 between the bends 41 and 42. The parallel legs of the member 74 extend perpendicularly from the base plate 72 into the opening 26. The connecting cross bar of the member 74 extends parallel to the base plate 72. The member 74 is mounted horizontally on the automobile 10. When the sliding door 14 is in the closed position, the member 74 extends into the space 36 in the sliding door 14. Toward this end, the door rear panel 34 and the door-lock plate 62 are formed with aligned slots 76 (see FIG. 3) for accommodating the strike 70. When the sliding door 14 is in the closed position, the connecting cross bar of the member 74 resides within the frame of the door-lock main section 60 and is parallelly spaced from the base plate 64.

The door-lock main section 60 and the strike 70 constitute a conventional door-lock 16. The main section 60 includes a movable engagement member (not shown), such as a forked bolt or a pinion. This engagement member is designed to engage the strike 70 to hold the sliding door 14 in place with respect to the rear side portion 12 when the sliding door 14 is in the closed position. When the sliding door 14 is unlocked, the engagement member disengages from the strike 70 to allow movement of the sliding door 14 out of the closed position.

Figure 3:
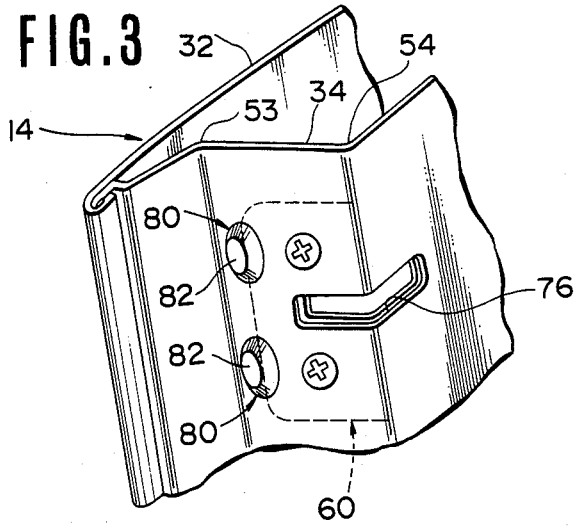
FIG. 3 is a perspective view of part of the sliding door of FIGS. 1 and 2.

As shown in FIGS. 2 and 3, the section of the door rear panel 34 between the bends 53 and 54 is formed with a pair of vertically-spaced circular embosses or projections 80, which protrude toward the strike base plate 72 when the sliding door 14 is in the closed position (the first relative position). The embosses 80 are equally distant from the horizontal plane of the U-shaped member 74 in the opposite vertical directions. Each of the embosses 80 has a circular flat top 82 extending parallel to the rest of the section of the door rear panel 34 between the bends 53 and 54. When the sliding door 14 is in the closed position, the tops 82 oppose the strike base plate 72 and are parallelly or equally distant from the latter.

To prevent the embosses 80 from contacting the convex bend 42 and the edge 44 of the rear side portion 12 as the sliding door 14 moves into and out of the closed position (the first relative position), the height of the embosses 80 is chosen so that the resulting locus of each top 82 will lie slightly forward of the bend 42 and the edge 44. In the case where the sliding door 14 is in the closed position (the first relative position), the horizontal distance $l_1$ between each top 82 and the strike base plate 72 is smaller than the horizontal distance $l_2$ between the frame base plate 64 and the connecting cross bar of the strike member 74, the distances $l_1$ and $l_2$ being measured parallel to each other. Specifically, the distance in the longitudinal direction with respect to the automobile 10 between each top 82 and the strike base plate 72 is smaller than that between the frame base plate 64 and the connecting cross bar of the strike member 74. Therefore, if the rear side portion 12 and the sliding door 14 are displaced toward one another out of the first relative position in a collision involving the automobile 10, the strike base plate 72 will come into contact with the tops 82 of the embosses 80 before the connecting cross bar of the strike member 74 reaches the frame base plate 64. In this case, the embosses 80 remaining in contact with the strike base plate 72 serve to obstruct or resist further displacement of the strike 70 toward the door-lock main section 60, thereby acting to prevent the connecting cross bar of the strike member 74 from reaching the frame base plate 64. In this way, the embosses 80 serve to prevent the collision between the connecting cross bar of the strike member 74 and the frame base plate 64. The embosses thus serve as a means for preventing the lock strike from directly contacting the lock frame, when the side body and the sliding door are displaced toward one another out of the first relative position. The force from the strike base plate 72 striking the embosses 80 will be absorbed by deformation of the embosses 80 and dissipated via the door panels 30, 32, and 34, so that almost no force will be transmitted to the door-lock main section 60. As a result, the embosses 80 serve to prevent deformation of the door-lock main section 60 which can easily damage the door-lock 16.

It should be understood that further modification and variations may be made in this invention without departing from the spirit and scope of this invention as set forth in the appended claims. For example, the door-lock strike may be attached to the sliding door and the door-lock main section may be attached to the rear side portion. In this case, the embosses should be formed on the rear side portion.

What is claimed is:

1. An arrangement, comprising:

(a) a vehicle side body defining an opening;

(b) a sliding door arranged to slide relative to the side body, wherein the sliding door slides between an open position exposing said opening and a closed position covering said opening, and wherein the sliding door and the side body define a first relative position when the sliding door is in the closed position;

(c) a lock-frame base plate fixed to the sliding door;

(d) a lock-strike base plate fixed to the side body;

(e) a lock-strike engagement member fixed to the lock-strike base plate and extending toward the lock-frame base plate, wherein the lock-strike engagement member is spaced from the lock-frame base plate by a first longitudinal distance when the sliding door is in the closed position;

(f) a projection formed on the sliding door and protruding toward the lock-strike base plate, wherein the projection is spaced from the lock-strike base plate by a second longitudinal distance when the sliding door is in the closed position;

wherein said second longitudinal distance is smaller than said first longitudinal distance, and wherein, when the side body and the sliding door are displaced toward one another out of said first relative position, said projection comes into contact with the lock-strike base plate before the lock-strike engagement member reaches the lock-frame base plate.

2. An arrangement as recited in claim 1, wherein the sliding door therein defines a space in which the lock-frame base plate is located, and the sliding door has an aperture through which the lock-strike engagement member extends when the sliding door is in the closed position.

3. An arrangement as recited in claim 1, wherein the projection comprises an emboss having a height such that the emboss does not contact the side body when the sliding door moves between the closed position and the open position.

4. An arrangement as recited in claim 1, wherein the projection is integral with a wall of the sliding door.

5. An arrangement comprising:

(a) a vehicle side body defining an opening;

(b) a sliding door arranged to slide relative to the side body, wherein the sliding door slides between an open position exposing said opening and a closed position covering said opening, and wherein the sliding door and the side body define a first relative position when the sliding door is in the closed position;

(c) a lock frame;

(d) a lock strike;

(e) wherein the lock frame is fixed to the sliding door and the lock strike is fixed to the side body;

(f) means for preventing the lock strike from directly contacting the lock frame when the side body and the sliding door are displaced toward one another out of said first relative position; and wherein the preventing means comprises an emboss formed on the sliding door, the emboss being operative to contact the lock strike to resist further displacement of the lock strike relative to the lock frame when the side body and the sliding door are displaced toward one another out of said first relative position, and wherein the emboss has a height such that the emboss does not contact the side body when the sliding door moves between the closed position and the open position.

6. An arrangement as recited in claim 5, wherein the emboss is integral with a wall of the sliding door.

* * * * *